United States Patent [19]

Dallas

[11] Patent Number: 4,506,788

[45] Date of Patent: Mar. 26, 1985

[54] MAGNETIC CASSETTE FOR RADIOGRAPHIC FILM MATERIAL

[76] Inventor: Donald Dallas, 641 Grovewood Dr., Gretna, La. 70053

[21] Appl. No.: 521,689

[22] Filed: Aug. 10, 1983

[51] Int. Cl.[3] ..... B65D 85/38; B65D 81/30; B65D 65/16; G03B 11/00

[52] U.S. Cl. ..... 206/455; 206/813; 206/818; 378/184

[58] Field of Search ..... 206/455, 818, 813; 378/184

[56] References Cited

U.S. PATENT DOCUMENTS

| | | | |
|---|---|---|---|
| 2,677,910 | 5/1954 | Morgan | 206/818 |
| 2,894,141 | 7/1959 | Kollock | 378/184 |
| 3,237,327 | 3/1956 | Griggs | 206/818 |
| 3,952,204 | 4/1976 | Davis et al. | 378/184 |

*Primary Examiner*—William T. Dixson, Jr.

*Attorney, Agent, or Firm*—Bode & Smith

[57] ABSTRACT

A radiographic film cassette having a plurality of magnet components integral with the cassette holder for adhering the cassette to ferrous material in X-raying for defects in welds or fissures in shipyards, pipe lines, or the like. What is provided is a substantially flexible cassette envelope comprising first and second layers of radiographic intensifying screens with a sheet of radiographic film positioned therebetween. The cassette would be a cassette envelope constructed of waterproof fabric or other suitable material providing a light-free environment, and having the ability to flex around the curvature of the surface of a pipe or the like to be x-rayed. There is further provided a plurality of magnet components, preferably situated in each corner of the cassette envelope and flexibly attached thereto for overall adherence of the envelope to the surface of the pipe or the like to be x-rayed during the process.

7 Claims, 4 Drawing Figures

MAGNETIC CASSETTE FOR RADIOGRAPHIC FILM MATERIAL

BACKGROUND OF THE INVENTION

1. Field of the Invention

The apparatus of the present invention relates to cassettes for x-ray films. More particularly, the present invention relates to a cassette holder for radiographic film material having magnetic components for adhering to the item being x-rayed.

2. General Background

In the field of radiographic photography, cassettes are widely used for holding the x-ray sensitive film. For example, in the medical field, film cassettes are used widely in conjunction with the x-ray machines found in hospitals and doctors' offices. Also, in the field of non-destructive testing, wherein welds between sections of pipe, or metal plates, must be x-rayed in order to determine if the weld is proper, or if there are other fissures in the metal, the x-ray film is very often loaded in a cassette so that it is in a light-free environment and is then placed on the item that is being x-rayed. It is imperative that the cassette placement be proper, and not be adjusted by field personnel during the exposure. In view of the fact that several types of radiation are encountered in industrial x-rays such as iridium 192, cobalt 60, it is imperative that the field personnel have little or no exposure to the x-ray process, and must be maintained in distance and shielded away from enduring the exposure to the ray.

Oftentimes, a problem is encountered in the industrial x-raying of cylindrical items, such as pipe welds and the like, wherein the cassette must be placed along a curvatured weld in order to determine if the weld is indeed free of flaws. Naturally, since the cassette cannot simply be placed on the item to be welded, there must be a means for adhering the cassette to the item, without the field personnel making contact at the time of exposure. At the present state of the art, the x-ray film is contained in a flexible cassette holder, which is able to adhere to the curved surface, and is normally held in place with the use of masking tape or the like around the item to be x-rayed. Oftentimes, problems are encountered with this particular method. For example, the masking tape can only be used a single time and disposed of which is very uneconomical. Should the masking tape or the like be wet, it will fail to hold and the object to be x-rayed must be dried in order to accomplish the x-ray. Therefore, this rather primitive means of adhering the cassette to the surface of the item to be welded is very unsatisfactory.

Several patents have been obtained in the art of cassettes for x-ray film, the most pertinent being as follows:

German Pat. DE-PS No. 1,112,887, relates to a cassette incorporating a sheet of elastic material which exerts magnetic contraction forces over its entire area for cooperating with an iron foil supported on the bottom of the cassette. This particular cassette is disadvantageous in that the very thin foil, which serves as a medium to which x-rays enter the internal space of a cassette, has a thermal expansion coefficient differing from that of the components on which the foil is supported, and very often becomes detached from its support folds, especially under temperature variations.

U.S. Pat. No. 2,811,251 issued to S. Yerkovich entitled "Means For Holding Cassettes In X-Ray Spot Film Devices" relates to an apparatus for holding an article within an enclosure so that spot film devices can be utilized for rapidly making radiographs. This in no way relates to a magnetic means for maintaining the cassette in place.

U.S. Pat. No. 3,499,147 issued to Goodman, et al, entitled "Cassette For Radiographic Film Material", relates to a cassette wherein a sandwich-type film holder combination with the cassette main frame is taught and adapted to compress the film holder into a light-tight structure when assembled.

U.S. Pat. No. 3,511,990 issued to Hauss entitled "Radiographic Film Cassette Having A Resilient Film Release Strip Therein" provides a film package or cassette having a pair of opposed interfaces. A layer of resilient material is disposed on at least one of the opposed faces and a strip of resilient material, having a greater thickness than the layer is provided along at least a portion of one edge of the layer of material so that the film contained is released from the resilient material.

U.S. Pat. No. 3,591,804 issued to Minasian entitled "Magnetically Attractive Marking Device And Holding Member For X-Ray Film Holder" relates to a film holder having markers for producing identifying images on the negative, with the markers having strips of magnetic material with identifying stencil letters cut therein. This particular patent does not, however, teach adhering of the cassette to the material to be x-rayed.

U.S. Pat. No. 3,704,369 issued to Paidosh entitled "X-Ray Film Cassette" teaches the use of an improved cassette for providing improved contact between the intensifying screen and the sensitized film.

U.S. Pat. No. 3,829,699 issued to Anspach, Jr. entitled "Holder For X-Ray Cassettes" teaches the use of a cassette holder for x-ray cassettes which can be made sterile and easily used in an operating room having means for sealing the inner side of the container cap to prevent contamination.

U.S. Pat. No. 3,971,470 issued to White entitled "X-Ray Cassette Film Holder" wherein the improvement is basically a means of providing the tray and the mating lid to be automatically urged into tight engagement when they are closed together.

U.S. Pat. No. 4,114,044 issued to Chiulli entitled "Radiographic Cassette Adapter" wherein is provided a means for allowing a large x-ray film cassette holder to be fitted with the adapter for allowing the use of smaller film so that various sizes of cassettes are not necessitated.

U.S. Pat. No. 4,313,538 issued to Bauer, et al, entitled "Film Cassette With An Opening For Exposing Data On A Film Accommodated Therein" provides a cassette particularly adapted with an enclosable opening through which data can be exposed onto a pre-determined portion of the film accommodated within an internal compartment of a cassette.

U.S. Pat. No. 4,331,236 issued to Bauer entitled "Container For X-Ray Film" having a first chamber for the film and a relatively narrow elongated second chamber for housing an elongated data carrier card, the two being separate and apart.

U.S. Pat. No. 4,350,248 issued to Bauer entitled "X-Ray Film Cassette With Magnetically Attracted Confining Plates" teaches the use of a cassette having two separate parts which are connected on one side by a hinge and which are connectable on the second end with a magnetic plate supported cassette wall and attracting a ferromagnetic foil for eliminating air inclusion between the intensifying shields and the x-ray film interposed therebetween. Although this patent does teach the use of a magnetic means within the cassette, it does not address the problem of the cassette being adhered to the object being x-rayed.

U.S. Pat. No. 4,346,300 issued to Turner entitled "Film Sheet Cassette" relates to a frame wherein a pressure plate between the front and back plate is held in operative position by the force of magnetic repulsion by an array of magnetic poles between the plates. Again, like the previous patent, this patent does use magnetic means within the cassette but not means for adapting the cassette to the item being x-rayed.

SUMMARY OF THE PRESENT INVENTION

The preferred embodiment of the apparatus of the present invention solves the problem encountered in the present state of the art in a simple and straightforward manner. What is provided is a radiographic film cassette having a plurality of magnet components integral with the cassette holder for adhering the cassette to ferreous material in x-raying for defects in welds or fissures in shipyards, pipe lines, or the like. What is provided is a substantially flexible cassette envelope comprising first and second layers of radiographic intensifying screens with a sheet of radiographic film positioned therebetween. The cassette would be a cassette envelope constructed of waterproof fabric or other suitable material providing a light-free environment, and having the ability to flex around the curvature of the surface of a pipe or the like to be x-rayed. There is further provided a plurality of magnet components, preferably situated in each corner of the cassette envelope and flexibly attached thereto for overall adherence of the envelope to the surface of the pipe or the like to the x-rayed during the process.

Therefore, it is an object of the present invention to provide a radiographic cassette having the ability to be adapted to curvatured objects such as pipe or the like.

It is a further object of the present invention to provide a radiographic cassette having means for properly adapting a cassette to the surface to be x-rayed over substantially its entire body portion.

It is a further object of the present invention to provide a flexible x-ray film cassette which can be positioned at any vertical or horizontal placement on the item to be x-rayed without the use of extraneous tape or the like for adherence thereto.

In order to accomplish the above objects, it is one feature of the present invention to provide a flexible radiographic film cassette which is waterproof and provides a light-free environment for the x-ray film therein.

It is a further feature of the present invention to provide a flexible film cassette having a plurality of magnet components integral thereto for adhering to the undersurface or the like of the item to be x-rayed.

It is still a further feature of the present invention to provide a flexible cassette holder with the magnet components situated at preferably the four corners in order to achieve overall adherence of the cassette to the surface to be x-rayed.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein:

FIG. 1 is and overall view of the preferred embodiment of the apparatus of the present invention illustrating the apparatus adhering to the surface of a pipe or the like;

DETAILED DESCRIPTION OF THE PREFERRED EMBODIMENT

Figure 1:
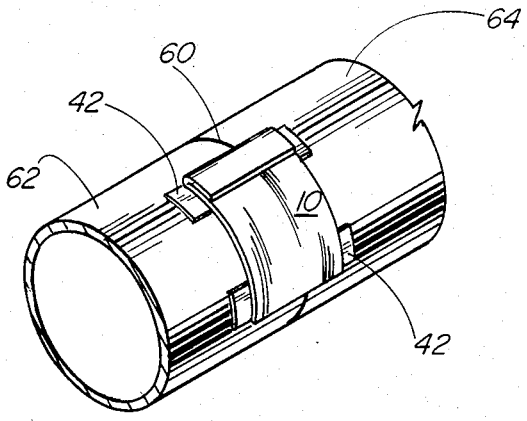
Figure 2:
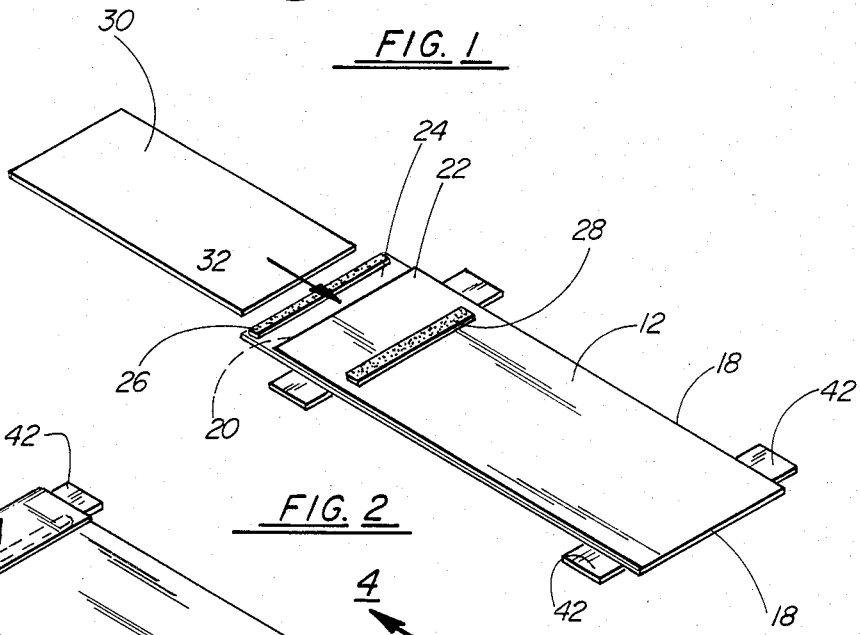
FIG. 2 is an overall perspective view of the preferred embodiment of the apparatus of the present invention illustrating the apparatus in the open position receiving a sheet of x-ray film therein.
Figure 3:
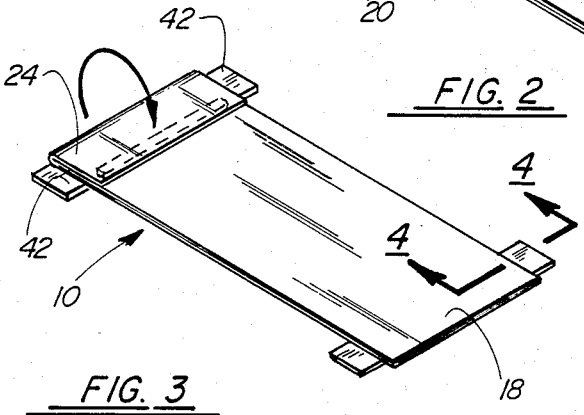
FIG. 3 is a perspective view of the preferred embodiment of the apparatus of the present invention illustrating the apparatus in the closed position with a sheet of x-ray film contained therein.
Figure 4:
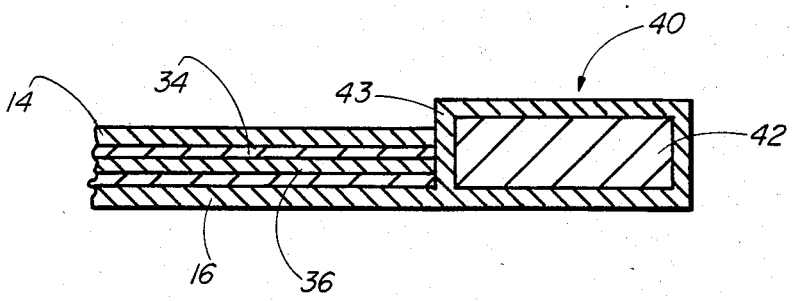
FIG. 4 is a partial cross-sectional view along lines 4—4 of FIG. 3 illustrating the position of one of the magnet component of the preferred embodiment of the apparatus of the present invention.

FIGS. 1 through 4 illustrate the preferred embodiment of apparatus of the present invention as illustrated by the numeral 10. As seen in FIGS. 2 through 4, magnetic cassette apparatus 10 provides an envelope 12 having an upper side portion 14 and a lower underside portion 16 adhered through gluing or stitching or the like along a common edge or border 18, for defining a space 20 therewithin. As seen in the FIGURES, envelope 12 would be open-ended and a first end 22 wherein a flap 24 is provided as an extension of lower surface 16 for moving into the closed position as seen in FIG. 3, by having adapted thereto a strip of Velcro or the like 26 on its end, for adhering to a second strip of Velcro 28 integrally attached to surface 12 forming a closed pocket as seen in FIG. 3. In the open position, as seen in FIG. 2, envelope 12 is able to slidably accommodate the necessary items to be placed within space 20, for use of the apparatus. As seen in FIG. 2, there is illustrated a sheet of x-ray film 30, which, as seen by arrow 32 can slidably engage into space 20, for positioning within envelope 12. As seen in cross-sectional FIG. 4, prior to the placement of the film 30 within envelope 12, there is provided an upper intensifying screen 34 and a lower intensifying screen 36, which would generally be of the same dimensions as x-ray film 30, and would serve to intensify the x-rayed item appearing on film 30. Following the positioning of film 30 and intensifying screens 34 and 36 within pocket 20, FIG. 3 illustrates the view of envelope 12 in the closed position, with flap 24 sealably engaged by Velcro pads 26 and 28 with space 20 being waterproof and light resistant therewithin.

As seen in the FIGURES, there is further provided adhering magnet means 40 for each of the four corners of envelope 12, which generally comprise a plurality of magnet members 42 housed within the material layer which envelope 12 is constructed. As seen in FIG. 4, in cross-sectional view, magnet means 40 would simply be a rectangular magnet member 42 having the ability to adhere to ferrous material and the like, which normal pipe or tubing is constructed for use in oil field or oil chemical plant work. As seen in FIG. 4, magnet member 42 is contained within an extension of lower surface 16 which provides an overlapping integral pocket 43 for housing each of magnet members 42 at the four corners of the apparatus as seen in FIGS. 2 and 3.

In order to fully understand the operation of the apparatus, FIG. 1 illustrates apparatus 10 as adhering to a weld 60 between a first section of pipe 62 and a second section of pipe 64. In a normal course of construction, weld 60 would be x-rayed along its entire weld length in order to determine whether or not any flaws have occurred in the weld which may result in leakage of the pipe during use. Therefore, the apparatus of the present invention, as seen in FIG. 1, following the positioning of the intensifying screens 34 and 36 and film 30 within space 20 of the apparatus, apparatus 10 would be positioned onto a portion of weld 60, as seen in FIG. 1, with magnet components 42 serving to hold the apparatus in place along that particular section of pipe. What is essential in this particular FIGURE, is the fact that apparatus 10 can be positioned at any place along weld 60, whether it be the upper side portions or underside of the weld, with the plurality of magnet members 42 providing a secure means for adhering flexible envelope 12 to the curvature of the pipe 62 and 64 during the x-raying process. The positioning of magnet members 42 at each corner of the apparatus, as seen in the FIGURE, provides for a uniform adaptability of apparatus 10 along the curvature of weld 60, without the necessity of extraneous matters such as tape or the like adhering the apparatus thereto. Also, the apparatus may be freely moved along the section of the pipe as the x-ray process continues, without the need for removal of tape or the like therefrom.

Furthermore, as seen in the FIGURES, magnet components 42 are positioned in such a way as to in no way come into contact with x-ray film 30, or impede the x-raying of the particular weld in question. Also, because magnets 42 are housed in the flexible bottom layer 16 as a continuation thereof, the magnet members are able to flex accordingly should the x-ray cassette have to be placed in a position which would require flexing of the magnet members in order to properly adhere the cassette to the necessary surface.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A cassette for housing radiographic film, comprising:

a. an envelope portion open-ended at a first end, having top and bottom portions defining an x-ray film receiving space therebetween;

b. means for closing said open-ended first end for disallowing light therewithin; and c. magnetic means comprising a plurality of individual magnet members situated along the length of said envelope for uniformly adhering said envelope to the surface to be x-rayed.

2. The apparatus of claim 1, wherein said envelope is constructed of flexible material or the like.

3. The apparatus of claim 1, wherein said individual magnet members are flexibly adhered to said envelope for allowing engagement to the surface to be x-rayed.

4. A cassette for housing x-ray film, particularly adapted for use in conjunction with x-raying of industrial pipe lines and the like, comprising:

a. a flexible envelope, open-ended at a first end, generally comprising a upper and lower surface, for defining a space for accommodating x-ray film therewithin;

b. a plurality of magnet members substantially situated at each corner of said envelope, for providing means to adhere said envelope to the pipe or the like to be x-rayed; and c. means for sealing said envelope for disallowing light to enter said envelope during the x-ray process.

5. The apparatus in claim 4 wherein said magnet members are housed within a flexible layer of material of said envelope.

6. The apparatus of claim 4 wherein each of said magnet members are flexibly attached to said envelope at each of the said four corners of said envelope.

7. The apparatus in claim 4 wherein said means for closing said envelope comprises a flat member sealably engageable to at least one surface of said envelope in the closed position.

* * * * *